US006572421B2

(12) United States Patent
Sadakata

(10) Patent No.: US 6,572,421 B2
(45) Date of Patent: Jun. 3, 2003

(54) TILT DEVICE FOR MARINE PROPULSION UNIT

(75) Inventor: Kazuhiko Sadakata, Gyoda (JP)

(73) Assignee: Showa Corporation, Saitama (JP)

( * ) Notice: Subject to any disclaimer, the term of this patent is extended or adjusted under 35 U.S.C. 154(b) by 0 days.

(21) Appl. No.: 09/941,529

(22) Filed: Aug. 29, 2001

(65) Prior Publication Data

US 2002/0031959 A1 Mar. 14, 2002

(30) Foreign Application Priority Data

Sep. 1, 2000 (JP) ..... 2000-265865

(51) Int. Cl.[7] ..... B63H 20/08
(52) U.S. Cl. ..... 440/61 D
(58) Field of Search ..... 440/53, 61; 91/55; 92/169.1

(56) References Cited

U.S. PATENT DOCUMENTS 3,473,325 A 10/1969 Vargo
3,828,556 A * 8/1974 Nolden ..... 60/432
5,149,285 A * 9/1992 Kinoshita ..... 440/61
5,156,561 A * 10/1992 Kinoshita ..... 440/61
6,048,235 A * 4/2000 Kai ..... 440/61
6,059,228 A * 5/2000 Koizumi et al. ..... 244/102 A
6,159,061 A * 12/2000 Gorokawa ..... 440/61
6,282,893 B1 * 9/2001 Porter et al. ..... 92/110

FOREIGN PATENT DOCUMENTS

JP 11-198894 7/1999

* cited by examiner

*Primary Examiner*—S. Joseph Morano
*Assistant Examiner*—Andrew Wright
(74) *Attorney, Agent, or Firm*—Rosenthal & Osha L.L.P.

(57) ABSTRACT

A tilt device for a marine propulsion unit is disclosed having a damp bracket fixed to the hull of a vessel a swivel bracket tilting connected to the damp bracket, a cylinder device disposed between the damp bracket and the swivel bracket, and a pump device for extending and contacting the cylinder device, where in the cylinder device and the pump device are arranged in series.

4 Claims, 6 Drawing Sheets

TILT DEVICE FOR MARINE PROPULSION UNIT

BACKGROUND OF THE INVENTION

1. Field of the Invention

The present invention relates to a tilt device for marine propulsion unit.

2. Description of the Related Art

A tilt device for a marine propulsion unit typically includes a clamp bracket fixed on the hull side, a swivel bracket tiltably connected to the clamp bracket, designating a horizontal axis as a center of rotation, a cylinder device intervened between the damp bracket and the swivel bracket, and a pump device for extending and contracting the cylinder device, wherein a propelling unit is supported by the swivel bracket.

The prior art includes a first type in which a cylinder device and a pump device are arranged in parallel (prior art 1), and a second type in which the pump device is arranged in an L-shape on the lower side of the cylinder device (prior art 2)(Japanese Patent Application Laid-Open (JP-A) No. 11-198894).

In the prior art 1, the width of the clamp bracket and the swivel bracket becomes large and their weight becomes heavy, so that the cylinder device and the pump device do not interfere with the clamp bracket and the swivel bracket.

In the prior art 2, since a motor of the pump device protrudes towards the side, there is a possibility that a person may put his foot thereon, and the pump device may be damaged.

In both prior art 1 and prior art 2, since the center of gravity of the assembly of the cylinder device and the pump device offsets largely with respect to the center of the damp bracket and the swivel bracket, it is necessary to reinforce the mechanical strength of the damp bracket and the swivel bracket, thereby making the assembly heavy.

SUMMARY OF THE INVENTION

Embodiments of the present invention miniaturize and decrease the weight of the damp bracket and swivel bracket, and avoid protrusion of the pump device towards the side.

Embodiments of the present invention relate to a tilt device for a marine propulsion unit comprising a damp bracket fixed on the hull side, a swivel bracket tiltably connected to the damp bracket, designating a horizontal axis as a center of rotation, a cylinder device disposed between the damp bracket and the swivel bracket, and a pump device for extending and contracting the cylinder device, and supporting a propelling unit with the swivel bracket, wherein the cylinder device and the pump device are arranged in series almost vertically.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENTS

First Embodiment (FIG. 1–FIG. 4)

Figure 1:
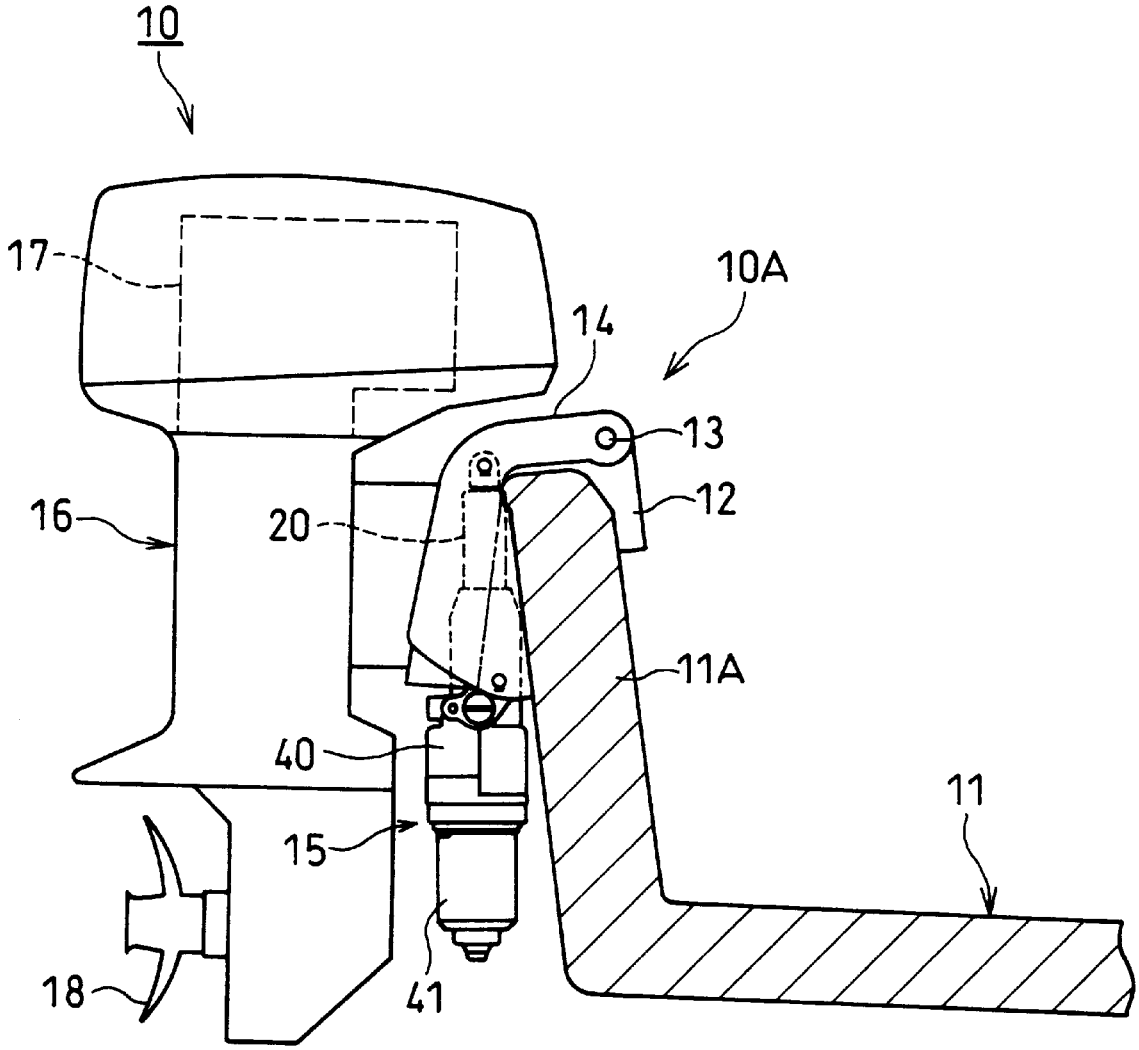
FIG. 1 is a diagram showing a marine propulsion unit.

A tilt device 10A for a marine propulsion unit 10 (outboard motor, however, it may be an inboard/outboard motor), as shown in FIG. 1, fixes a damp bracket 12 to the stem board 11A of the hull 11, connects tiltably the swivel bracket 14 to the damp bracket 12, designating a horizontal axis 13 as a center of rotation, places a power unit 15 between the damp bracket 12 and the swivel bracket 14 to achieve a desired configuration, and supports a propelling unit 16 by the swivel bracket 14 via a shaft of a rudder for controlling the direction arranged perpendicularly. The propelling unit 16 comprises an engine unit 17 on the upper part thereof, and a propeller 18 on the bottom part thereof.

Figure 2:
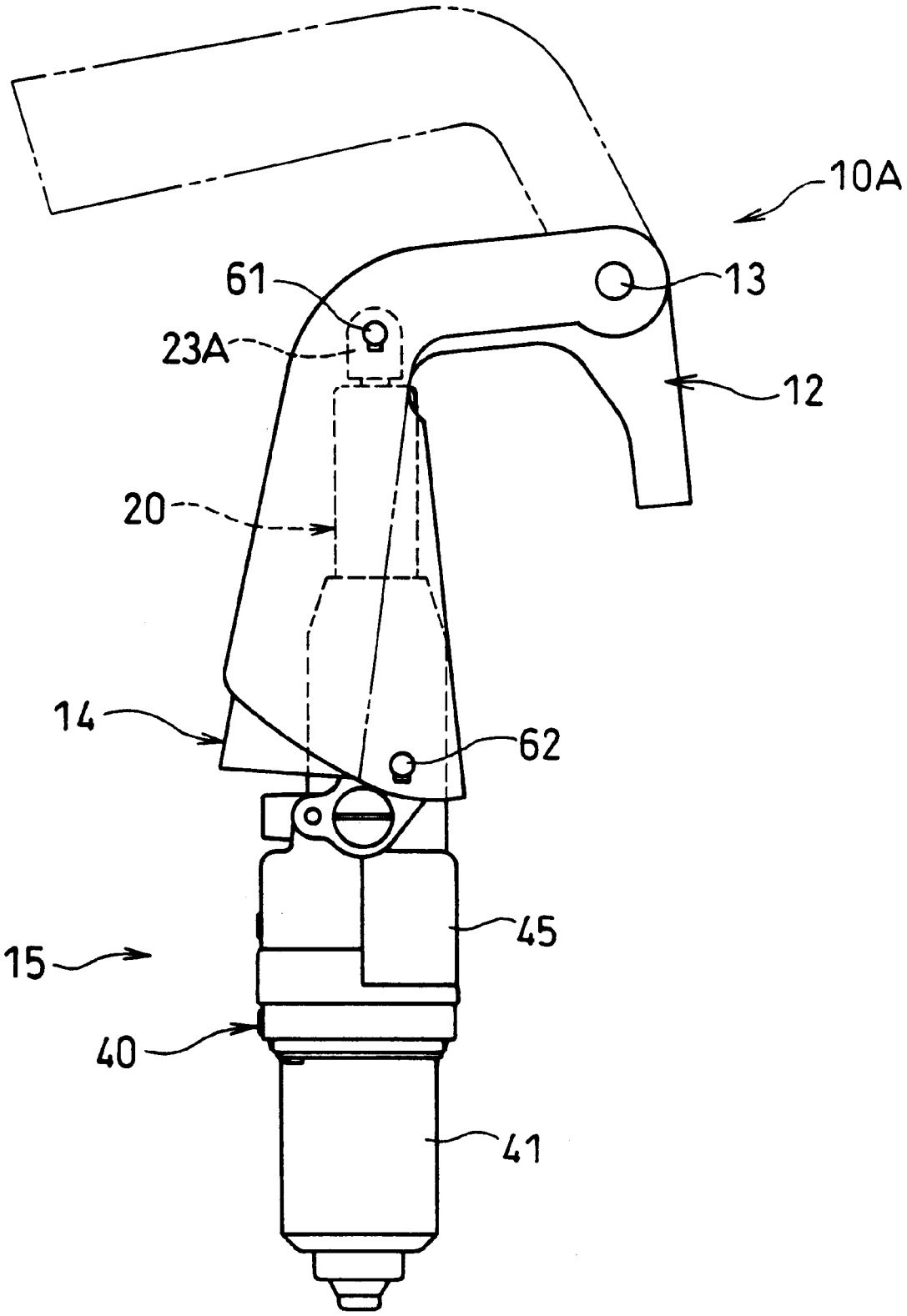
FIG. 2 is a side view showing a tilt device in first embodiment.
Figure 3:
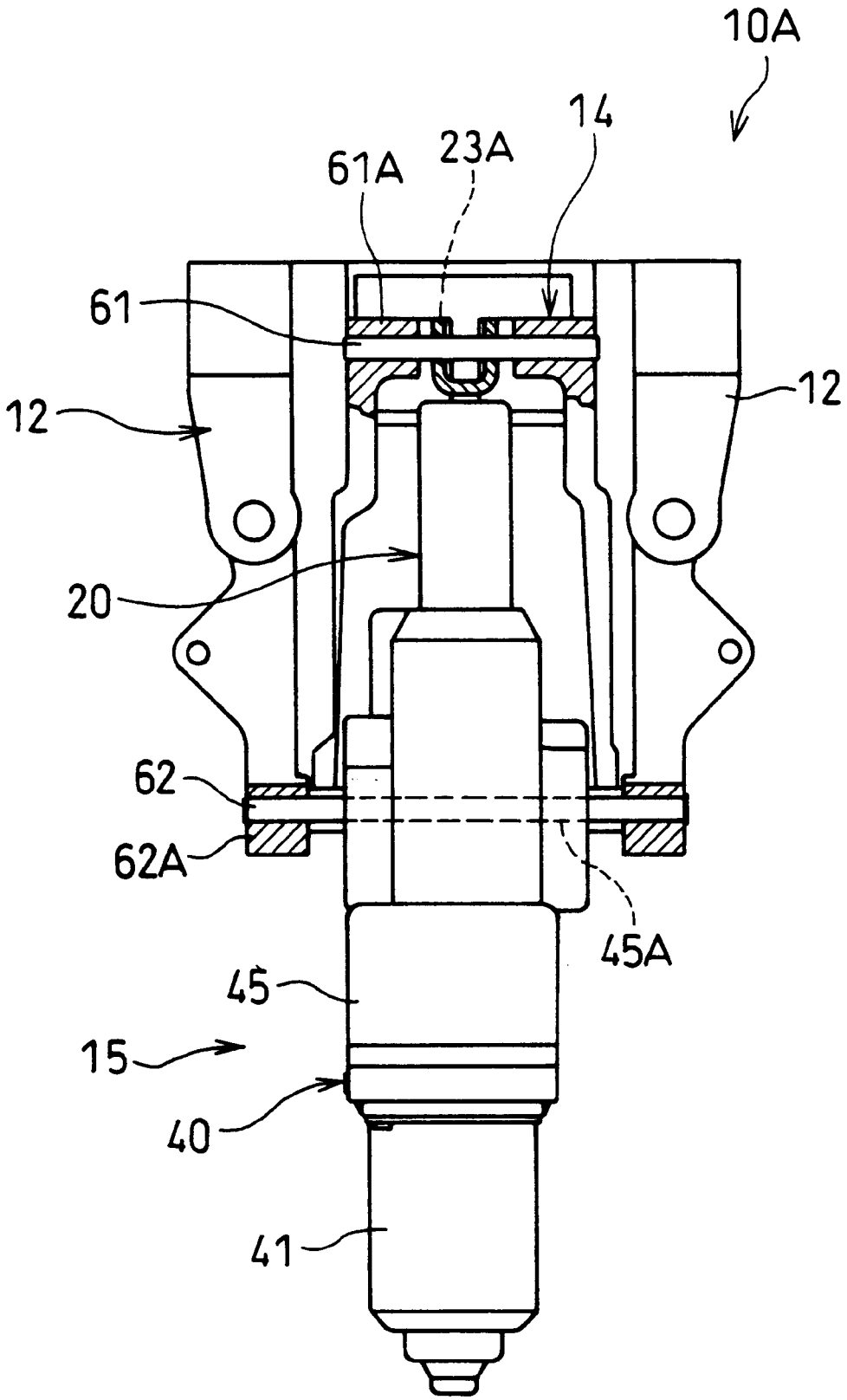
FIG. 3 is an elevational view of FIG. 2.

The power unit 15 comprises a cylinder device 20 and a pump device 40, as shown in FIGS. 2 and 3, as an assembly in which the cylinder device 20 and the pump device 40 are arranged in series almost vertically. The cylinder device 20 is disposed between the damp bracket 12 and the swivel bracket 14. The pump device 40 is for extending and contracting the cylinder device 20.

Figure 4:
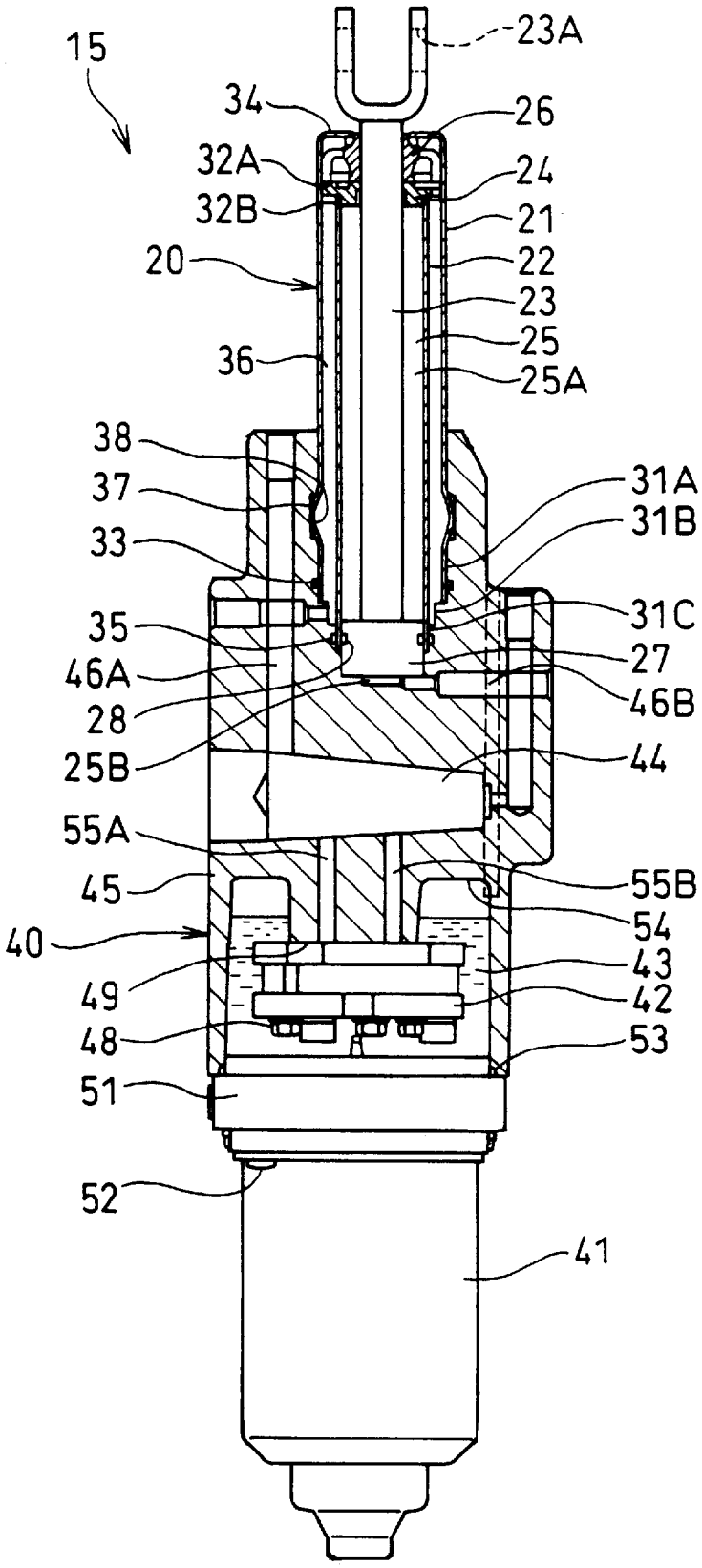
FIG. 4 is a sectional view showing a power unit.

Cylinder Device 20 (FIG. 4)

The cylinder device 20 is connected to a valve block 45 (pump accommodating) of the pump device 40 and integrally coupled therewith. The cylinder device 20 has an outer cylinder 21 and an inner cylinder 22 constructed of a solid-drawn steel pipe, with these cylinders 21, 22 connected in series to the valve block 45. The valve block 45 is manufactured by casting of, for example, aluminum alloy, and comprises an insertion hole 45A for a fitting pin with respect to the clamp bracket 12.

The cylinder device 20 also has a piston rod 23 connected to the swivel bracket 14. This piston rod 23 is inserted into a tilt chamber 25 of the inner cylinder 22, so as to be able to extend and contract, from a rod guide 24 as provided at the opening end of the outer cylinder 21. The rod guide 24 comprises a sealing member 26 sliding in contact with the piston rod 23. The piston rod 23 comprises an insertion hole 23A for a fitting pin with respect to the swivel bracket 14.

The cylinder device 20 also has a piston 27 fixed to the end of the piston rod 23 in the tilt chamber 25 of the inner cylinder 22. The piston 27 comprises an O-ring 28 sliding in contact with the inner face of the inner cylinder 22, to thereby divide the tilt chamber 25 into a first tilt chamber 25A on the side for accommodating the piston rod 23 (rod-side oil chamber) and a second tilt chamber 25B on the side of not accommodating the piston rod 23 (piston-side oil chamber).

The cylinder device 20 also concentrically comprises a large-diameter hole 31A, a medium-diameter hole 31B and a small-diameter hole 31C, at the upper end of the valve block 45, and further comprises concentric large-diameter portion 32A and small-diameter portion 32C in the rod guide 24. Then, one end of the outer cylinder 21 is fitted into the large-diameter hole 31A of the valve block 45 via an O-ring 33, and the other end of the outer cylinder 21 is attached by being fitted with the large-diameter portion 32A of the rod guide 24 and secured there by a chalking portion 34. One end of the inner cylinder 22 is fitted into the small-diameter hole 31C of the valve block 45 via an O-ring 35, and the other end of the inner cylinder 22 is attached by being fitted with the small-diameter portion 32C of the rod guide 24 and secured there. As a result, an oil path 36 in the ring cavity form is formed between the outer cylinder 21 and the inner cylinder 22, and the first tilt chamber 25A and the oil path 36 are connected by an oil path opened to the inner cylinder 32 (or a communicating channel provided in the rod guide 24)(not shown). Moreover, the oil path 36 communicating to the first tilt chamber 25A is communicated to a first oil path 46A communicating to the medium-diameter hole 31 B of the valve block 45, and the second tilt chamber 25B is communicated to a second oil path 46B provided in the valve block 45, respectively.

The structure for connecting the cylinder device 20 to the valve block 45 is obtained by providing a ring groove 37 to give an arc shape or a rectangular shape in section in the large-diameter hole 31 A of the valve block 45, inserting one end of the outer cylinder 21 into this large-diameter hole 31, making the one end of the outer cylinder 21 protrude in an expanded condition by bulging to thereby form a bulge portion 38, and making the bulge portion 38 engage with the ring groove 37.

The pump device 40 comprises a reversible motor 41, a reversible gear pump 42, a tank 43, and a channel 44 with a switching valve, so as to be able to supply and discharge hydraulic fluid to/from the first tilt chamber 25A and the second tilt chamber 25B of the cylinder device 20 via the first oil path 46A and the second oil path 46B provided in the valve block 45 (pump accommodating).

At this time, the pump device 40 has the channel 44 with a switching valve built in the valve block 45 consisting of an aluminum alloy casting, and comprises the first oil path 46A, the second oil path 46B, a switching valve, a manual valve, a relief valve in order to correspond to a volume change of the oil due to an increase of the oil temperature, and a relief valve for compensating the volume of the piston rod 23 entering into the inner cylinder 22. Then, the valve block 45 comprises the large-diameter hole 31A, the medium-diameter hole 31B and the small-diameter hole 31C, for connecting the cylinder device 20 at the upper end portion, and also comprises a tank 43 (pump chamber) at the bottom end portion, as described above. The tank 43 accommodates the hydraulic fluid, as well as comprising the pump 42 in the state of being dipped into the hydraulic fluid. The pump 42 is arranged inversely within the tank 43, and fixed to a mounting face 49 of the valve block 45 with bolts 48.

In the pump device 40, a faucet section in an end plate 51 of the motor 41 is fitted to the bottom end of the valve block 45 forming the tank 43, and secured by a bolt 52, and the tank 43 is sealed in a fluid-tight manner by an O-ring 53 fitted on the faucet section in the end plate 51. In the valve block 45, the upper space of the tank 43 is used as a concave air hole 54, and the pump 42 is arranged in the oil in the tank 43, and draws in the oil from the bottom part thereof, and hence it does not draw in the air. The pump 42 discharges the oil drawn in from the tank 43 to the oil path 55A or 55B from the mounting face 49 of the valve block 45, and supplies the oil from the switching valve in the channel 44 with a switching valve, through the first oil path 46A or the second oil path 46B, to the first tilt chamber 25A or the second tilt chamber 25B of the cylinder device 20. Also, the pump 42 returns the return oil from the first tilt chamber 25A or the second tilt chamber 25B of the cylinder device 20, through the first oil path 46A or the second oil path 46B of the valve block 45, and the switching valve in the channel 44 with a switching valve, and from the oil path 55A or oil path 55B to the pump 42, or from each relief valve of the channel 44 with a switching valve to the tank 43.

In the tilt device 10A, the fitting pin 61 set in the insertion hole 23A for a fitting pin provided in the piston rod 23 of the power unit 15 is connected with a pin to the fitting hole 61A of the swivel bracket 14, and the fitting pin 62 set in the insertion hole 45A for a fitting pin provided in the valve block 45 is connected with a pin to the fitting hole 62A of the damp bracket 12, thereby the tilt device 0A is fitted to the clamp bracket 12 and the swivel bracket 14.

Therefore, the tilt operation of the tilt device 10A is as follows:

(1) Tilt down

When the motor 41 and the pump 42 are rotated normally, the oil discharged from the pump 42 is supplied to the first tilt chamber 25A of the cylinder device 20, and the hydraulic fluid in the second tilt chamber 25B is returned to the pump 64, thereby contracting the cylinder device 20 to cause tilt down.

(2) Tilt up

When the motor 41 and the pump 42 are inversely rotated, the oil discharged from the pump 42 is supplied to the second tilt chamber 25B of the cylinder device 20, and the hydraulic fluid in the first tilt chamber 25A is returned to the pump 42, thereby extending the cylinder device 20 to cause tilt up.

According to this embodiment, the following action can be obtained.

(1) Since the cylinder device 20 and the pump device 40 are arranged in series almost vertically, the width of the damp bracket 12 and the swivel bracket 14 can be made a small size that can accommodate the cylinder device 20, enabling miniaturization and lightening of the clamp bracket 12 and the swivel bracket 14.

(2) The center of gravity of the assembly of the cylinder device 20 and the pump device 40 can be made to agree substantially with the center of the damp bracket 12 and the swivel bracket 14, and it is not necessary to reinforce the mechanical strength of the damp bracket 12 and the swivel bracket 14, thereby enabling lightening.

(3) Since the pump device 40 does not protrude laterally, there is no possibility that a person put his foot on the pump device 40. Thus, damage of the pump device 40 can be avoided.

(4) The pump device 40 protrudes downward of the cylinder device 20, and the motor 41 of the pump device 40 can be also arranged in water, thereby enabling improvement in the cooling efficiency.

(5) The cylinders 21, 22 constituting the cylinder device 20 are formed of a tubing material, and these cylinders 21, 22 are connected in series to the valve block 45 of the pump device 40, thereby lightening can be promoted Moreover, in this embodiment, since in the valve block 45, the upper space of the tank 43 is used as a concave air hole 54, even if the oil surface level is changed due to rolling of the hull or the like, aeration of the pump 42 and the cylinder device 20 can be avoided. Therefore the tilt lock of the cylinder device 20 can be stabilized.

Figure 5:
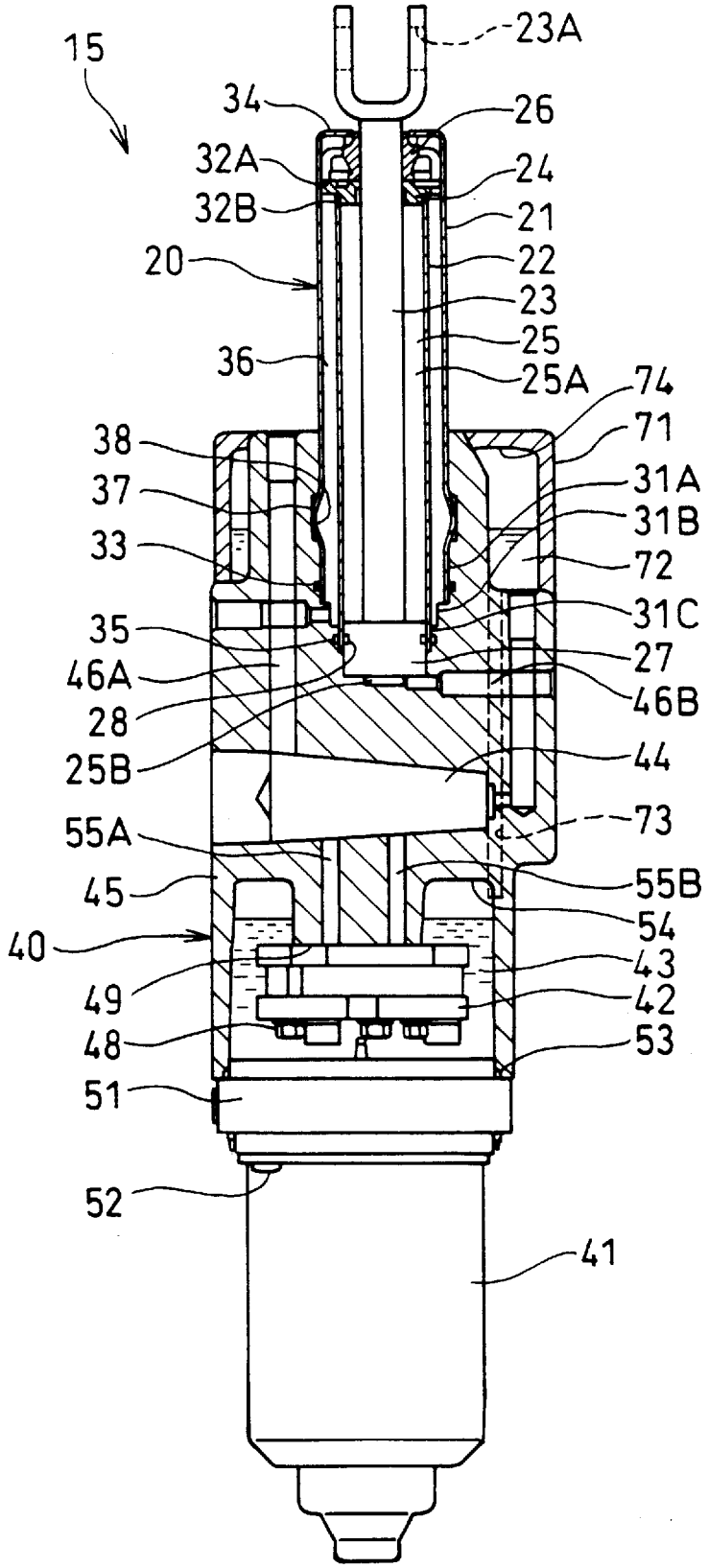
FIG. 5 is a sectional view showing a power unit in a second embodiment.

Second Embodiment (FIG. 5)

The different point between the second embodiment in FIG. 5 and the first embodiment in FIG. 4 is that a sub tank 72 divided fluid-tightly by a resin cover 71 or the like is provided on the upper end side of the valve block 45, and a tank 43 having a pump 42 arranged therein and this sub tank 72 are communicated by a communicating path 73, to thereby form an air hole 74 in the upper space of the sub tank 72. According to this embodiment, the air is prevented from getting mixed in the tank 43, and aeration to the pump 42 and the cylinder device 20 can be also prevented reliably. A partition wall comprising a bladder or a free piston may be intervened between the sub tank 72 and the air hole 74.

Figure 6:
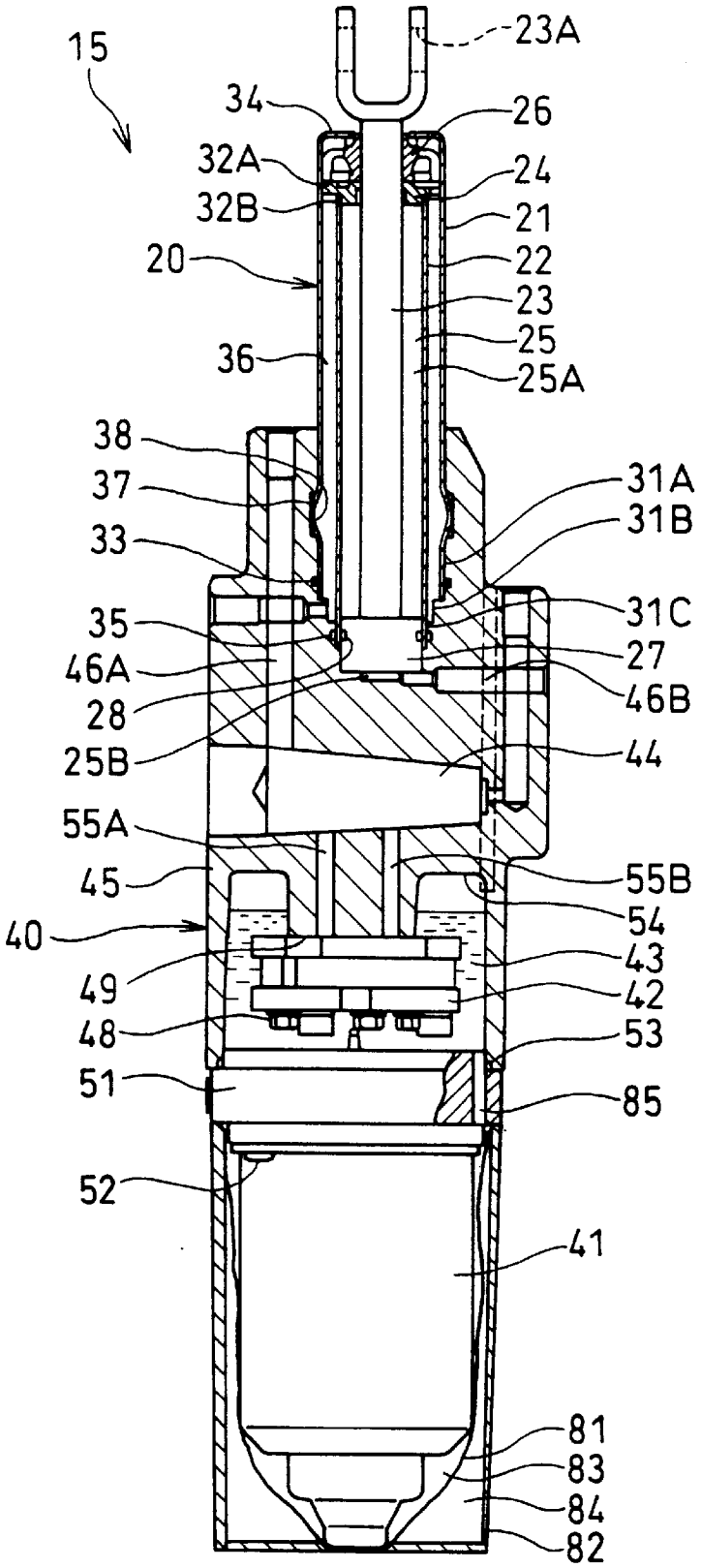
FIG. 6 is a sectional view showing a power unit in a third embodiment.

Third Embodiment (FIG. 6)

The different point between the third embodiment in FIG. 6 and the first embodiment in FIG. 4 is that a resin cover 82 or the like is provided fluid-tightly around the motor 41, via a partition wall 81 comprising a bladder or a free piston, designating the inside of the partition wall 81 as a sub tank 83, and the outside thereof as an air hole 84, and a tank 43 having a pump 42 arranged therein and the sub tank 83 are communicated by a communicating path 85 provided in an end plate of the motor 41. According to this embodiment, air can be completely prevented from getting mixed into the tank 43, and aeration to the pump 42 and the cylinder device 20 can be also prevented completely.

As heretofore explained, embodiments of the present invention have been described in detail with reference to the drawings. However, the specific configurations of the present invention are not limited to the embodiments but those having a modification of the design within the range of the present invention are also included in the present invention. For example, the cylinder constituting the cylinder device and the valve block of the pump device may be integrally molded in series by an aluminum alloy casting or the like.

Moreover, in executing the present invention, the cylinder device in the tilt device may be one obtained by arranging a tilt cylinder and a trim cylinder in series.

As described above, according to the present invention, the damp bracket and the swivel bracket can be miniaturized and lightening, and protrusion of the pump device towards the side can be avoided.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tilt device for a marine propulsion unit comprising:

a clamp bracket adapted to be fixed to the hull;

a swivel bracket tiltably connected to the clamp bracket, designating a horizontal axis as a center of rotation;

a cylinder device comprising a cylinder formed of a tubing material and connected in series to a valve block of a pump device, the cylinder being disposed between the clamp bracket and the swivel bracket, the pump device for extending and contracting the cylinder device;

wherein a propelling unit of the marine propulsion unit is supported by the swivel bracket, the cylinder device and the pump device are arranged in a substantially vertical series, and wherein a motor of the pump device is connected in series to said valve block, using a space formed by said motor and the valve block as a tank for accommodating hydraulic fluid, and wherein a pump is arranged in the space formed by said motor and the valve block, and said pump is fixed inversely to the valve block;

the tilt device further comprising a sub tank for hydraulic fluid provided on a cylinder side of said valve block, wherein the sub tank communicates with the tank via a communicating path.

2. A tilt device for a marine propulsion unit according to claim 1, wherein a cylinder constituting said cylinder device and a valve block of the pump device are integrally molded in series.

3. A tilt device for a marine propulsion unit according to claim 1, wherein the valve block of said pump device is formed of an aluminum alloy casting.

4. A tilt device for marine propulsion unit according to claim 1, wherein a resin cover is provided in a fluid-tight fashion around said motor via a partition wall, designating the inside of the partition wall as a sub tank, and the outside thereof as an air hole, the tank and the sub tank are communicated by a communicating path provided in an end plate of the motor.

* * * * *